US011013377B2

(12) United States Patent
Katsurayama et al.

(10) Patent No.: US 11,013,377 B2
(45) Date of Patent: May 25, 2021

(54) TOILET SYSTEM

(71) Applicant: LIXIL Corporation, Tokyo (JP)

(72) Inventors: Hideki Katsurayama, Tokyo (JP); Nobuyuki Matsuda, Tokyo (JP); Haruka Ue, Tokyo (JP); Taku Okawa, Tokyo (JP); Yohei Yukitake, Tokyo (JP); Yoshitaka Kouno, Tokyo (JP)

(73) Assignee: LIXIL Corporation, Tokyo (JP)

( * ) Notice: Subject to any disclaimer, the term of this patent is extended or adjusted under 35 U.S.C. 154(b) by 59 days.

(21) Appl. No.: 16/499,051

(22) PCT Filed: Jan. 17, 2018

(86) PCT No.: PCT/JP2018/001282

§ 371 (c)(1),
(2) Date: Sep. 27, 2019

(87) PCT Pub. No.: WO2018/179692

PCT Pub. Date: Oct. 4, 2018

(65) Prior Publication Data

US 2020/0029758 A1 Jan. 30, 2020

(30) Foreign Application Priority Data

Mar. 27, 2017 (JP) ..... JP2017-060763

(51) Int. Cl.
*A47K 17/00* (2006.01)
*E03D 9/00* (2006.01)

(52) U.S. Cl.
CPC ..... *A47K 17/00* (2013.01); *E03D 9/00* (2013.01)

(58) Field of Classification Search
CPC ..... A47K 17/00; E03D 9/00; E03D 11/00; E03D 2201/00; G08B 5/00
(Continued)

(56) References Cited

U.S. PATENT DOCUMENTS

2003/0110714 A1* 6/2003 Stark ..... A47K 17/00 52/34
2004/0143899 A1* 7/2004 Hughes ..... E04H 1/1277 4/661
(Continued)

FOREIGN PATENT DOCUMENTS

JP 02213535 A * 8/1990
JP H4-7800 A 1/1992
(Continued)

OTHER PUBLICATIONS

International Search Report dated Apr. 3, 2018, directed to International Application No. PCT/JP2018/001282; 2 pages.

*Primary Examiner* — Benjamin R Shaw
(74) *Attorney, Agent, or Firm* — Morrison & Foerster LLP

(57) ABSTRACT

Provided is a toilet system that can provide more detailed information about a use state of a toilet.

The toilet system includes: a detection unit (a door lock sensor, a seating sensor, a rotation sensor, a toilet washing switch, etc.) which detects a situation inside a toilet stall; and a control unit which determines, based on a detection result of the detection unit, that the toilet stall is in a vacant state or in an used state, and further makes at least one of a determination that the toilet stall in the used state is in a state immediately after a start of use and a determination that the toilet stall in the used state is in a state immediately before an end of use, and outputs a signal including determination results.

18 Claims, 17 Drawing Sheets

(58) Field of Classification Search
USPC ..... 4/661
See application file for complete search history.

(56) References Cited

U.S. PATENT DOCUMENTS

| | | | | |
|---|---|---|---|---|
| 2006/0137619 | A1* | 6/2006 | Dodman | E03D 9/007 119/163 |
| 2006/0226660 | A1* | 10/2006 | Wu | E05B 41/00 292/145 |
| 2007/0089340 | A1* | 4/2007 | Schuling | G09F 7/00 40/606.07 |
| 2017/0049915 | A1* | 2/2017 | Brais | A61L 2/10 |
| 2017/0372589 | A1* | 12/2017 | Becker | G16H 40/20 |
| 2020/0304944 | A1* | 9/2020 | Millius | G06K 7/1417 |
| 2020/0392710 | A1* | 12/2020 | Saruta | E03D 11/00 |
| 2020/0407963 | A1* | 12/2020 | Qin | E03D 11/00 |

FOREIGN PATENT DOCUMENTS

| | | | | | |
|---|---|---|---|---|---|
| JP | 2001-128899 | A | | 5/2001 | |
| JP | 2011100441 | A | * | 5/2011 | |
| JP | 5631648 | | | 11/2014 | |
| JP | 2016-91513 | | | 5/2016 | |
| JP | 2018161342 | A | * | 10/2018 | E03D 9/00 |

* cited by examiner

TOILET SYSTEM

CROSS-REFERENCE TO RELATED APPLICATIONS

This application is a U.S. national stage patent application under 35 U.S.C. 371 of International Application No. PCT/JP2018/001282, filed Jan. 17, 2018, which claims priority to Japanese Application No. 2017-060763, filed Mar. 27, 2017, the entire contents of each of which are incorporated herein by reference.

BACKGROUND OF THE INVENTION

The present disclosure relates to a toilet system.

Patent Literature 1 discloses a conventional toilet system. The toilet system includes a camera or an ultrasonic sensor as a detection unit, and a control unit. In the toilet system, the camera or the ultrasonic sensor detects a situation of a toilet, and based on the detection, the control unit determines a use state of the toilet and outputs the determination result. The determination result output from the control unit is displayed on an indicator.

Patent Literature 1: JP 5631648 B

BRIEF SUMMARY OF THE INVENTION

In the system of Patent Literature 1, two kinds of the use state of the toilet, i.e., "being used" and "not being used", are determined and displayed. However, even when the toilet is being used, it is unclear from the outside whether the use of the toilet has just stated so that it will take a long time for the toilet to be vacant, or the use of the toilet will end soon so that the toilet will be vacant soon. For this reason, a toilet system which can identify a more detailed use state has been desired.

Embodiments of the present invention have been made in view of the above-described conventional circumstances, and an object of the present invention is to provide a toilet system which can provide more detailed information about a use state of a toilet.

A toilet system of embodiments of the present invention include: a detection unit which detects a situation inside a toilet stall; and a control unit which determines, based on a detection result of the detection unit, that the toilet stall is in a vacant state and that the toilet stall is in a used state, and further makes at least one of a determination that the toilet stall in the used state is in a state immediately after a start of use and a determination that the toilet stall in the used state is in a state immediately before an end of use, and outputs a signal including determination results.

This toilet system detects the situation inside the toilet stall, makes at least one of a determination that the toilet stall is in the state immediately after the start of use and a determination that the toilet stall is in the state immediately before the end of use, as a state other than two states, i.e., the vacant state and the used state, and outputs the signal including the determination results. In this way, the toilet system of embodiments of the present invention can inform the outside whether the toilet stall will be vacant soon or not.

Therefore, the toilet system of embodiments of the present invention can provide more detailed information about the use state of the toilet.

The above-mentioned "output a signal including determination results" is intended to mean outputting a signal (information signal) for causing an announcement means, for example, an indicator such an indicator panel, a smart phone or a display, or a sound output device such as a speaker, to announce determination results.

DETAILED DESCRIPTION OF THE INVENTION

Embodiments of the present invention will be described.

In some embodiments, the control unit may make, based on a change in the detection result of the detection unit, at least one of a determination that the toilet stall has changed from the state immediately after the start of use to the used state and a determination that the toilet stall has changed from the used state to the state immediately before the end of use. In this case, it is possible to more accurately inform the outside whether the toilet stall will be vacant soon or not.

In some embodiments, when the control unit makes the determination that the toilet stall is in the state immediately before the end of use, the control unit may make the determination only when a plurality of predetermined conditions is satisfied. In this case, erroneous determination can be prevented by setting a plurality of conditions for excluding a normally improbable determination in advance; the condition is, for example, that it should not be determined for 10 seconds after the start of use of the toilet stall that the toilet stall is in the state immediately before the end of use, and the like. As a result, it is possible to more accurately inform the outside whether the toilet stall will be vacant soon or not.

In some embodiments, when the detection unit detects a predetermined situation after the control unit determines that the toilet stall is in the state immediately before the end of use, the control unit may determine that the toilet stool has changed to the used state. In this case, the situation inside the toilet stall is monitored even after announcement that the toilet stall is in the state immediately before the end of use, so that the announcement content can be returned to "used" according to the situation. Therefore, it is possible to more accurately inform the outside whether the toilet stall will be vacant soon or not.

Figure 1:
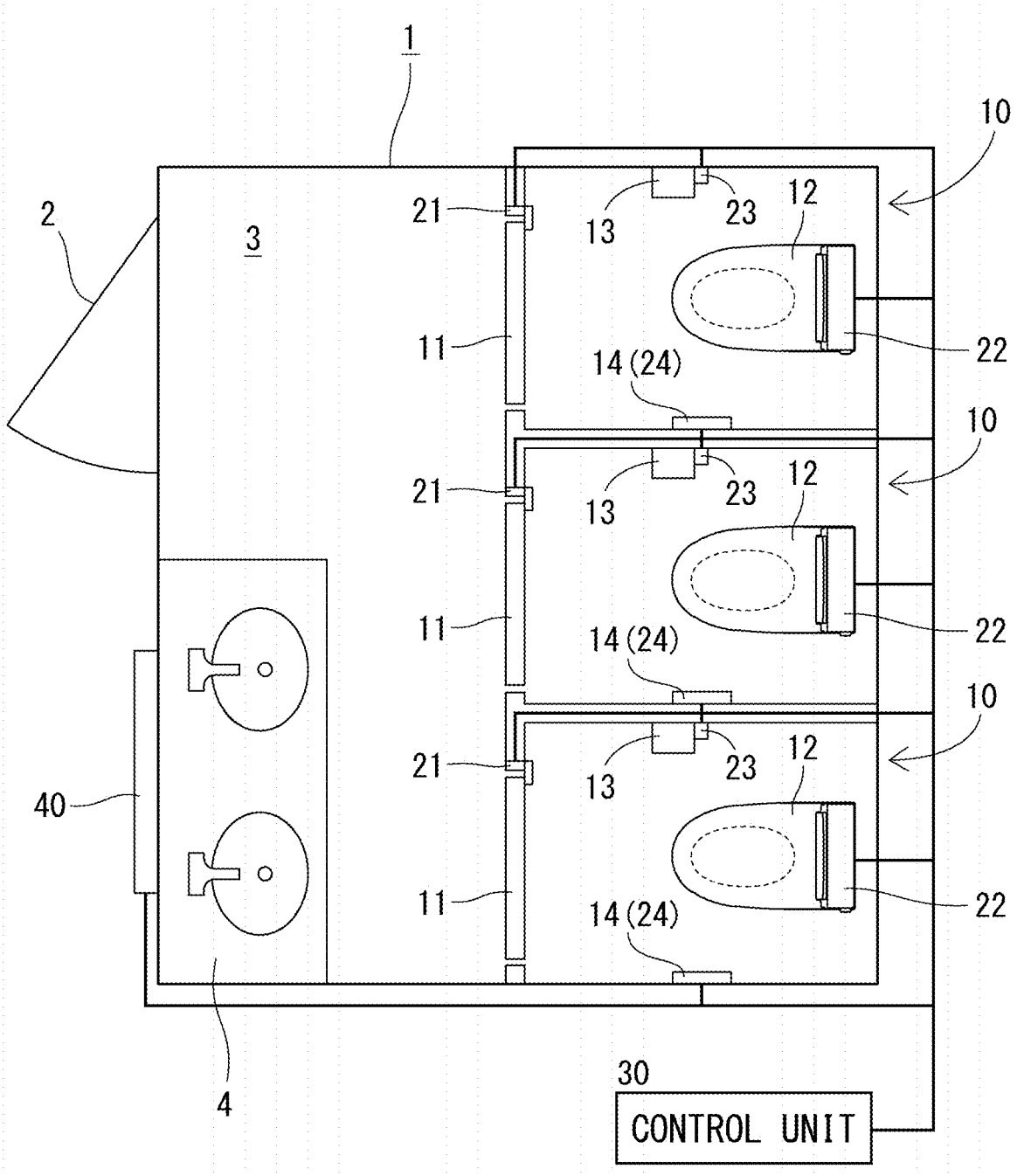
FIG. 1 is a view schematically showing a toilet system, according to some embodiments.

In some embodiments, toilet facility 1 includes a door 2 at a doorway, a common space 3 inside the door 2, a washstand 4 arranged in the common space 3, and a plurality (three in FIG. 1) of toilet stalls 10 provided to be partitioned from the common space 3.

Each of the toilet stalls 10 is provided with a door 11, a toilet bowl device 12, a paper holder 13, and a remote controller 14. The door 11 is a door for entering and leaving the toilet stall 10. The toilet bowl device 12 is equipped with a toilet seat device having a warm water washing function. The paper holder 13 rotatably holds a roll paper. The remote controller 14 is provided with various switches for performing operations of the toilet bowl device 12, such as opening and closing of a toilet seat and a toilet lid, private part washing, and toilet bowl washing, and the like.

Furthermore, each toilet stall 10 is provided with a door lock sensor 21, a seating sensor 22, a rotation sensor 23, and a toilet washing switch 24 as the detection units which detect the situation inside the toilet stall 10. The door lock sensor 21 detects whether the door 11 is locked. The seating sensor 22 detects whether the user is seated on the toilet seat of the toilet bowl device 12. The rotation sensor 23 detects whether the roll paper is rotating. The toilet washing switch 24 is a switch for washing the toilet bowl and is provided in the remote controller 14. The door lock sensor 21, the seating sensor 22, the rotation sensor 23, and the toilet washing switch 24 are connected to the control unit 30 and controlled by the control unit 30. Furthermore, the detection results by the door lock sensor 21, the seating sensor 22, the rotation sensor 23, and the toilet washing switch 24 are sent to the control unit 30. Based on these detection results, the control unit 30 makes a determination of the use state of each toilet stall 10. The determination result by the control unit 30 is announced by the announcement unit 40. The announcement unit 40 is an indicator that displays the determination result by the control unit 30 in characters and/or figures. The announcement unit 40 is arranged on the outer wall of the toilet facility 1. The announcement unit 40 announces information on the use state of each toilet stall 10.

In normal use for the purpose of defecation, it is assumed that the user of each toilet stall 10 performs operations such as locking, undressing, seating, private part washing, roll paper winding, private part wiping, leaving seat, toilet bowl washing, dressing, and unlocking, as operations incidental to defecation. Among these operations, locking and unlocking are operations which are respectively performed at the start of use (at the time of entry) of the toilet stall 10 and at the end of use (at the time of exit) of the toilet stall 10. Therefore, in some embodiments, the "vacant" state in which the toilet stall 10 is not used and the "used" state in which the toilet stall 10 is used are determined by the detection of locking and unlocking by the door lock sensor 21.

Furthermore, some of the above-described operations are performed in a random order before or after defecation depending on the user. Meanwhile, locking, undressing, seating, and the like are operations before defecation, and private part washing, private part wiping, toilet bowl washing, leaving seat, dressing, unlocking, and the like are operations after defecation. The operations before defecation are performed at a relatively early stage prior to the other operations after the user enters the toilet stall, and the operations after defecation are performed at a relatively late stage after the user enters the toilet stall and before leaving there. In some embodiments, one or more of these operations before and after defecation are focused. These operations are directly or indirectly detected as the situation inside the toilet stall, whereby it is determined that the toilet stall in the used state is in the state immediately before the end of use where the user will leave the toilet stall soon, or in the state immediately after the start of use where the user has just entered the toilet stall.

In some embodiments, a door lock sensor 21 and a seating sensor 22 as detection units, and a control unit 30 are included. This toilet system detects the situation inside the toilet stall 10 by detecting whether the door is locked by the door lock sensor 21 and detecting whether the user is seated by the seating sensor 22. Based on these detection results, the control unit 30 determines the use state of the toilet stall 10. Furthermore, the control unit 30 outputs a signal including the determination results. In some embodiments, the output signal is sent to an announcement unit 40. The announcement unit 40 receives the output signal and thereby announces the determination results by the control unit 30.

Figure 2:
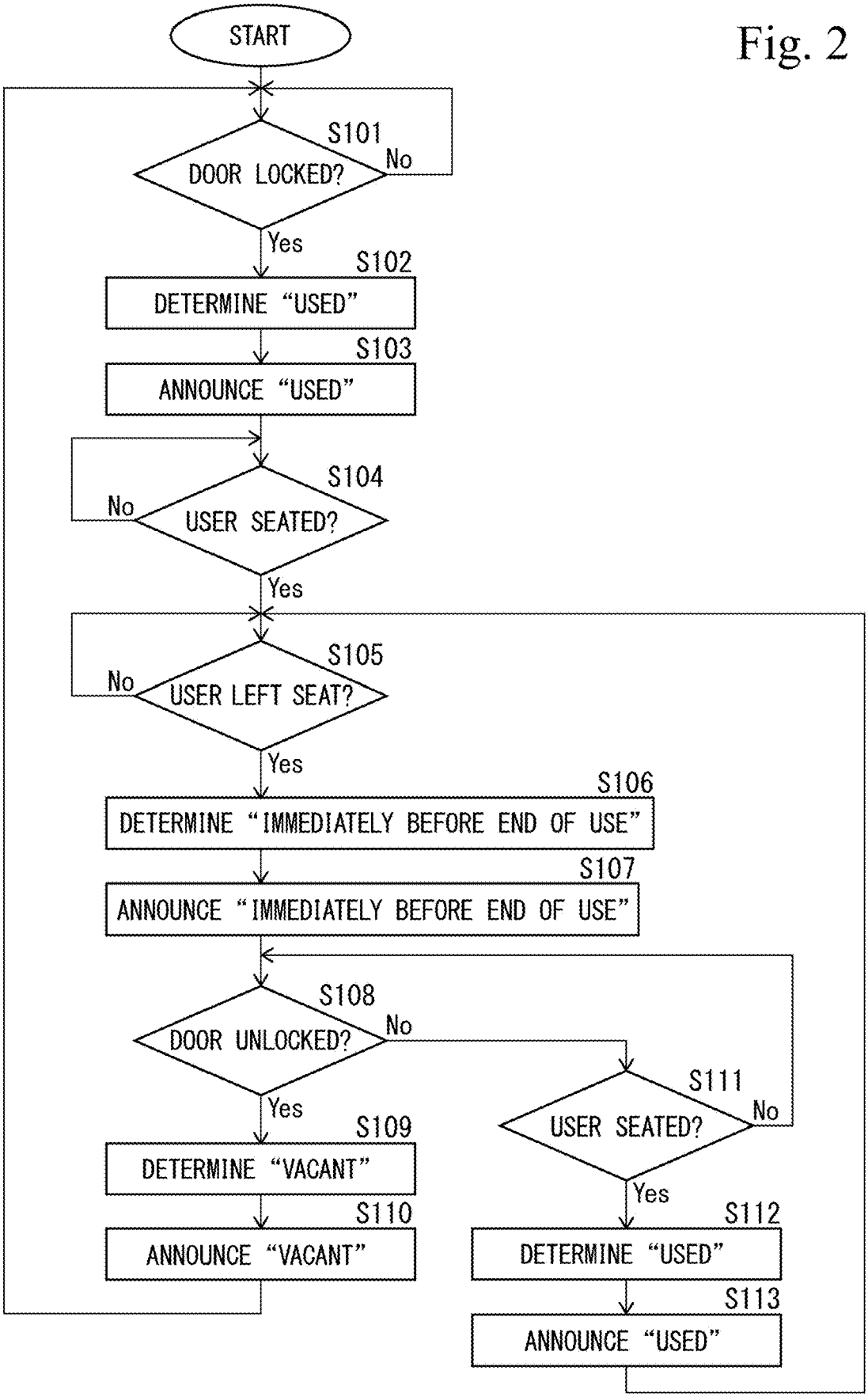
FIG. 2 is a flow chart showing the flow of processing of a toilet system, according to some embodiments.
Figure 3:
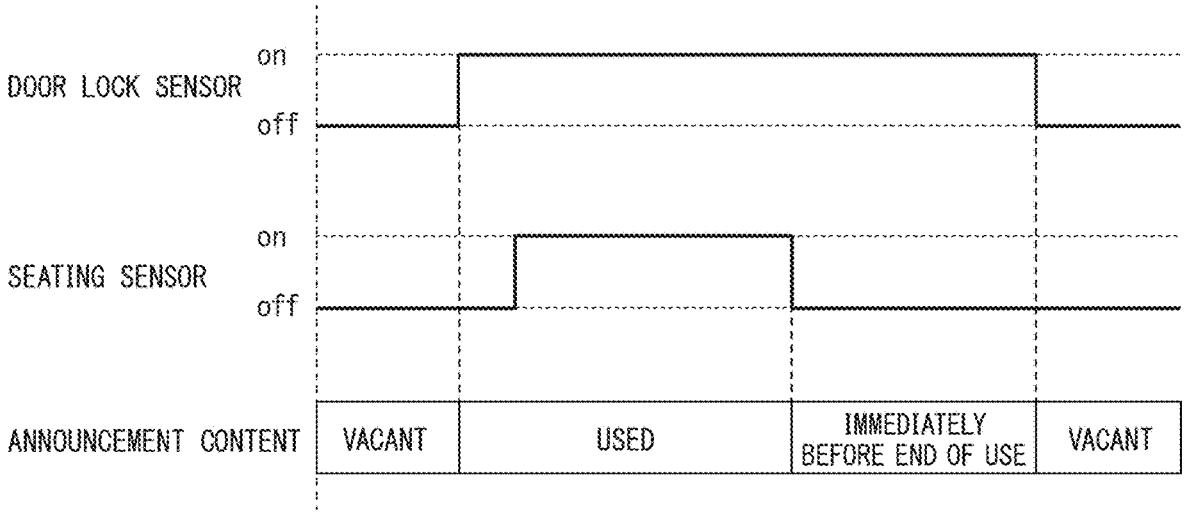
FIG. 3 is a time chart showing the relationship between detection signals and announcement contents of the toilet system, according to some embodiments.

The control processing of the toilet system having the above structure will be described using the flowchart in FIG. 2 and the timing chart in FIG. 3. First, as shown in FIG. 2, it is determined in step S101 whether the door 11 is locked. The determination as to whether the door 11 is locked is made by the door lock sensor 21.

If it is determined, in step S101, that the door 11 has been locked (the door lock sensor 21 is on), the control unit 30 determines that the toilet stall 10 is in a used state (step S102), and the announcement unit 40 announces the determination to that effect (step S103). That is, as shown in FIG. 3, when the door lock sensor 21 is switched from off to on, thereby the announcement content of the announcement unit 40 is switched from "vacant" to "used".

The vacant state of the toilet stall 10 is determined by the fact that the unlocked state of the door 11 is detected, i.e., the door lock sensor 21 is in the off state. This "vacant" state is a state where no user is in the toilet stall 10. On the other hand, the used state of the toilet stall 10 is determined based on the fact that the locked state of the door 11 is detected, i.e., the door lock sensor 21 is in the on state. The "used" state is a state where the user is in the toilet stall 10.

Next, in step S104, it is determined whether the user of the toilet stall 10 has been seated on a toilet seat of a toilet bowl device 12. The determination whether the user has been seated is made by the seating sensor 22. That is, when the seating sensor 22 is on, it is determined that the user is being seated, and when the seating sensor 22 is off, it is determined that the user is not seated. If it is determined that the user has been seated by the fact that the seating sensor 22 is on, the process proceeds to step S105. In step S105, it is determined whether the user of the toilet stall 10 has left the seat of the toilet bowl device 12, i.e., whether the on-state seating sensor 22 has been turned off. In some embodiments, the control unit 30 determines that the toilet stall 10 is in the state immediately before the end of use when it is determined that the user has left the seat. That is, the determination of "immediately before the end of use" is made by the determination that the user has left the seat.

If it is determined in step S105 that the user has left the seat (the seating sensor 22 is off), the control unit 30 determines that the toilet stall 10 is in the state immediately before the end of use (step S106). The determination result is output to the announcement unit 40. Then, the announcement unit 40 announces "immediately before the end of use" as the determination result of the control unit 30 (step S107). That is, as shown in FIG. 3, when the seating sensor 22 is switched from on to off, thereby the announcement content of the announcement unit 40 is switched from "used" to "immediately before the end of use". As described above, the control unit 30 determines that the state of the toilet stall 10 has been changed from the used state to the state immediately before the end of use, based on the change in the detection result from the on state to the off state of the seating sensor 22 as the detection unit.

Then, in step S108, it is determined whether the door 11 has been unlocked. If it is determined that the door has been unlocked (the door lock sensor 21 is off), the control unit 30 determines that the toilet stall 10 is in a vacant state (step S109), and the announcement unit 40 announces the determination to that effect (step S110). That is, as shown in FIG. 3, when the door lock sensor 21 is switched from on to off, thereby the announcement content of the announcement unit 40 is switched from "immediately before the end of use" to "vacant".

On the other hand, if it is determined that the door 11 has not been unlocked (the door lock sensor 21 is on), the process proceeds to step S111, and it is determined whether the user of the toilet stall 10 has been seated again on the toilet seat of the toilet bowl device 12. This assumes that the user of the toilet stall 10 may be seated again, for example, as having a call of nature again before unlocking. In this case, it is regarded that the toilet stall 10 will no longer be vacant soon, so that the announcement content of "immediately before the end of use" is returned to "used" again. Specifically, if it is determined again in step S111 that the user has been seated (the seating sensor 22 is on), the control unit 30 determines in step S112 that the toilet stall 10 is in the used state. In this case, the announcement unit 40 announces "used" again in step S113, and the process returns to step S105. As described above, in some embodiments, when the seating sensor 22 as the detection unit detects seating as a predetermined situation after the control unit 30 determines that the toilet stall 10 is in the state immediately before the end of use, the control unit 30 makes a determination that the situation of the toilet stall 10 has changed from the state immediately before the end of use to the used state.

When the door 11 has been unlocked without detection of seating in step S104, the determination that the toilet stall 10 is in the state immediately before the end of use is not made, but the announcement is directly switched from "used" to "vacant" upon the detection of the unlocking operation. That is, in some embodiments, only when locking and seating after locking, as a plurality of predetermined conditions, have been detected, the determination that the toilet stall 10 is in the state immediately before the end of use is made in the subsequent processing.

As described above, the toilet system includes: the door lock sensor 21 and the seating sensor 22 as the detection units which respectively detect whether the door is locked and whether the user is seated as the situation inside the toilet stall 10; and the control unit 30 which determines, based on the detection results of the door lock sensor 21 and the seating sensor 22, that the toilet stall 10 is in a vacant state and that the toilet stall 10 is in an used state, and further makes a determination that the toilet stall 10 in the used state is in the state immediately before the end of use, and outputs a signal including the determination results.

In order to detect the situation inside the toilet stall 10, the toilet system detects whether the door is locked by the door lock sensor 21 and whether the user is seated by the seating sensor 22, determines that the toilet stall 10 is in the state immediately before the end of use as a state other than the two states, i.e., the vacant state and the used state, and outputs a signal including the determination results. Thus, the toilet system of some embodiments can inform the outside whether the toilet stall will be vacant soon or not.

Therefore, the toilet system can provide more detailed information about the use state of the toilet.

Furthermore, the control unit 30 makes the determination that the state of the toilet stall 10 has changed from the used state to the state immediately before the end of use based on the change in the detection result of the seating sensor 22 as the detection unit. Therefore, it is possible to more accurately inform the outside whether the toilet stall will be vacant soon or not.

Furthermore, when the control unit 30 makes the determination that the toilet stall 10 is in the state immediately before the end of use, the control unit 30 make the determination only when locking and seating after locking, as a plurality of predetermined conditions, have been detected. According to this configuration, erroneous determination can be prevented. As a result, it is possible to more accurately inform the outside whether the toilet stall will be vacant soon or not.

Furthermore, when the seating sensor 22 as the detection unit detects seating as a predetermined situation after the control unit 30 determines that toilet stall 10 is in the state immediately before the end of use, the control unit 30 determines that the state of the toilet stall 10 has changed to the used state. According to this configuration, the situation inside the toilet stall can be monitored even after the announcement that the state of the toilet stall is in the state immediately before the end of use, and the announcement content can be returned to "used" according to the situation. Therefore, it is possible to more accurately inform the outside whether the toilet stall will be vacant soon or not.

In some embodiments, the toilet system has a toilet washing switch 24 as a detection unit in addition to the door lock sensor 21 and the seating sensor 22. Specifically, the toilet system according to some embodiments detects the situation inside the toilet stall 10 by detecting whether the door is locked by the door lock sensor 21, detecting whether the user is seated by the seating sensor 22, and detecting whether the toilet washing switch 24 is operated. Based on these detection results, the control unit 30 determines the use state of the toilet stall 10 and outputs a signal including the determination results. The signal output from the control unit 30 is sent to the announcement unit 40. The announcement unit 40 having received the signal announces the determination results by the control unit 30.

Figure 4:
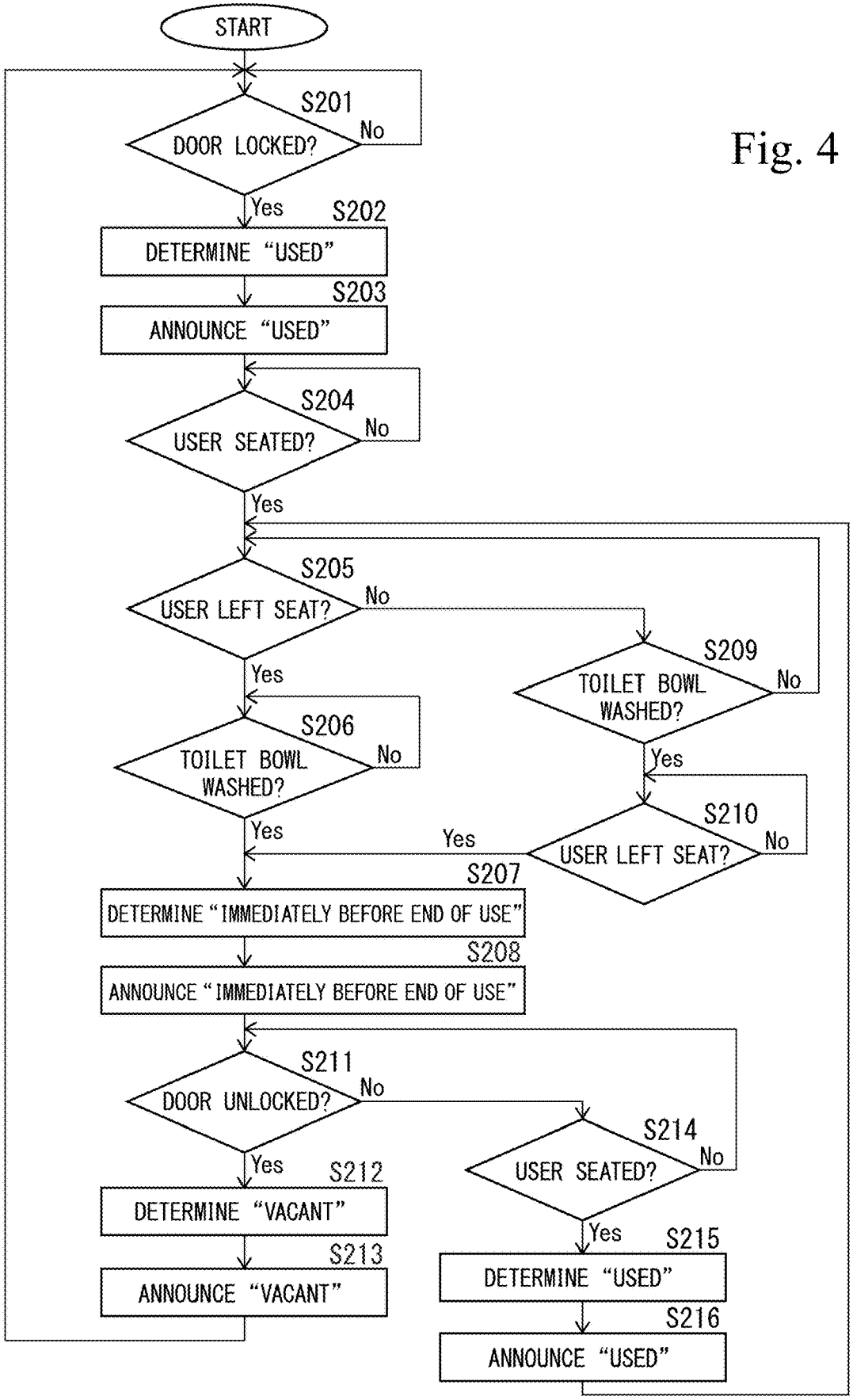
FIG. 4 is a flowchart showing the flow of processing of a toilet system, according to some embodiments.
Figure 5:
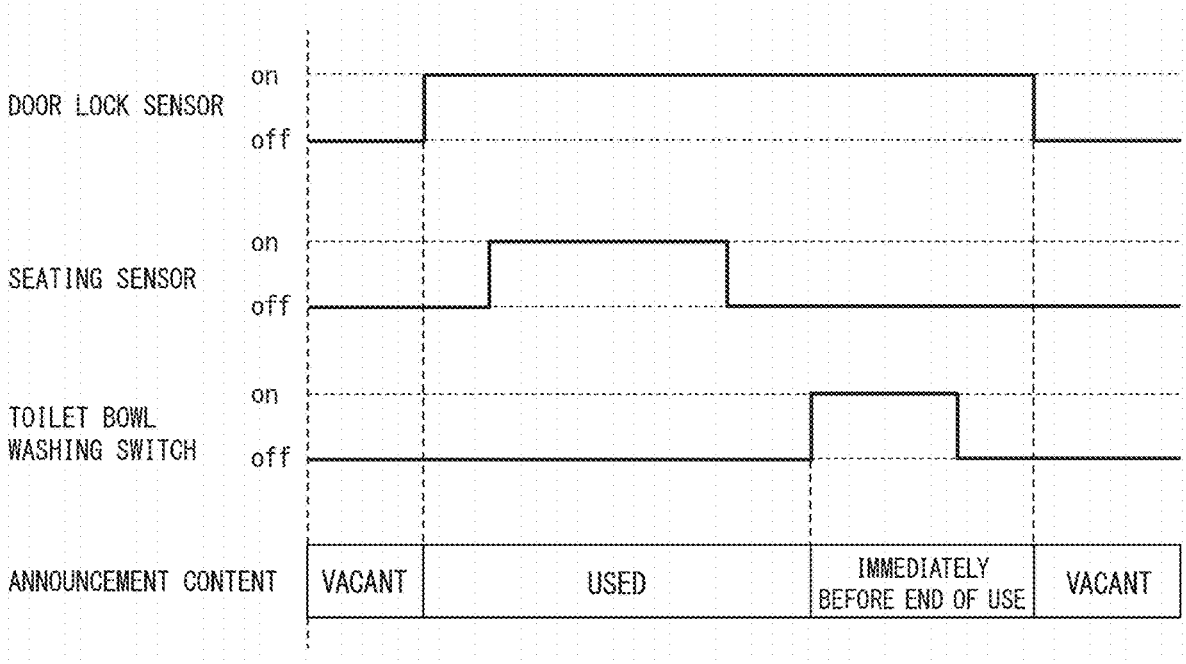
FIG. 5 is a time chart (No. 1) showing the relationship between detection signals and announcement contents of the toilet system, according to some embodiments.

The control processing of the toilet system having the above structure will be described using the flowchart in FIG. 4 and the timing charts in FIGS. 5 and 6. As shown in FIG.

4, in the control processing of the toilet system of some embodiments, it is detected in step S201 whether the door 11 is locked. When it is determined that the door 11 has been locked (the door lock sensor 21 is on), the control unit 30 determines that the toilet stall 10 is "used" (step S202), and the announcement unit 40 announces the determination to that effect (step S203). That is, as shown in FIGS. 5 and 6, when the door lock sensor 21 is switched from off to on, thereby the announcement content of the announcement unit 40 is switched from "vacant" to "used". These steps S201 to S203 are similar to steps S101 to S103. However, the control processing of the toilet system according to some embodiments determines by the control unit 30 that the toilet stall is in the state immediately before the end of use is made when it has been detected by the seating sensor 22 that the user has left the seat and also it has been detected that the toilet washing switch 24 has been operated.

Specifically, in step S204, it is determined whether the user of the toilet stall 10 has been seated on the toilet seat of the toilet bowl device 12, and, if it is determined that the user has been seated (the seating sensor 22 is on), it is subsequently detected whether the user has left the seat (steps S205, S210) and whether the toilet bowl has been washed (steps S206, S209). In some embodiments, the toilet system makes the determination that the toilet stall 10 is in the state immediately before the end of use only when locking and seating after locking have been detected, which means that a plurality of predetermined conditions is satisfied. The determination that the toilet stall 10 is in the state immediately before the end of use is made by detecting whether the user has left the seat and whether the toilet bowl has been washed.

In step S205, it is detected whether the user has left the seat. If it is determined in step S205 that the user has left the seat (the seating sensor 22 is off), it is then determined in step S206 whether the toilet bowl has been washed, that is, whether the toilet washing switch 24 has been operated. That is, the determination as to whether the toilet bowl has been washed in step S206 is the determination to be made after the user has left the seat. Thus, if it is determined that both of leaving the seat (the seating sensor 22 is off) and toilet bowl washing (the toilet washing switch 24 is on) have been performed, the control unit 30 determines that toilet stall 10 is in the state immediately before the end of use (step S207). The determination result is output to the announcement unit 40. Then, the announcement unit 40 announces "immediately before the end of use" as the determination result of the control unit 30 (step S208). That is, as shown in FIG. 5, in the case where the seating sensor 22 is switched from on to off first and then the toilet washing switch 24 is operated, the announcement content of the announcement unit 40 is switched from "used" to "immediately before the end of use" upon the operation of the toilet washing switch 24.

On the other hand, if it is determined in step S205 that the user has not left the seat (the seating sensor 22 is on), the process proceeds to step S209. In step S209, it is determined whether the toilet bowl has been washed, as in step S206, but the user at this time is in a seated state (state before leaving the seat). If it is determined in step S209 that the toilet bowl has been washed (the toilet washing switch 24 is on), the process proceeds to step S210. If it is not determined that the toilet bowl has been washed, the process returns to step S205. If it is determined in step S209 that the toilet bowl has been washed, it is determined in step S210 whether the user has left the seat. If it is determined that the user has left the seat, the process proceeds to step S207. Thus, if it is determined that both toilet bowl washing (the toilet washing switch 24 is on) and leaving the seat (the seating sensor 22 is off) have been performed, the control unit 30 determines that toilet stall 10 is in the state immediately before the end of use (step S207). Then, the announcement unit 40 announces "immediately before the end of use" as the determination result of the control unit 30 (step S208).

Figure 6:
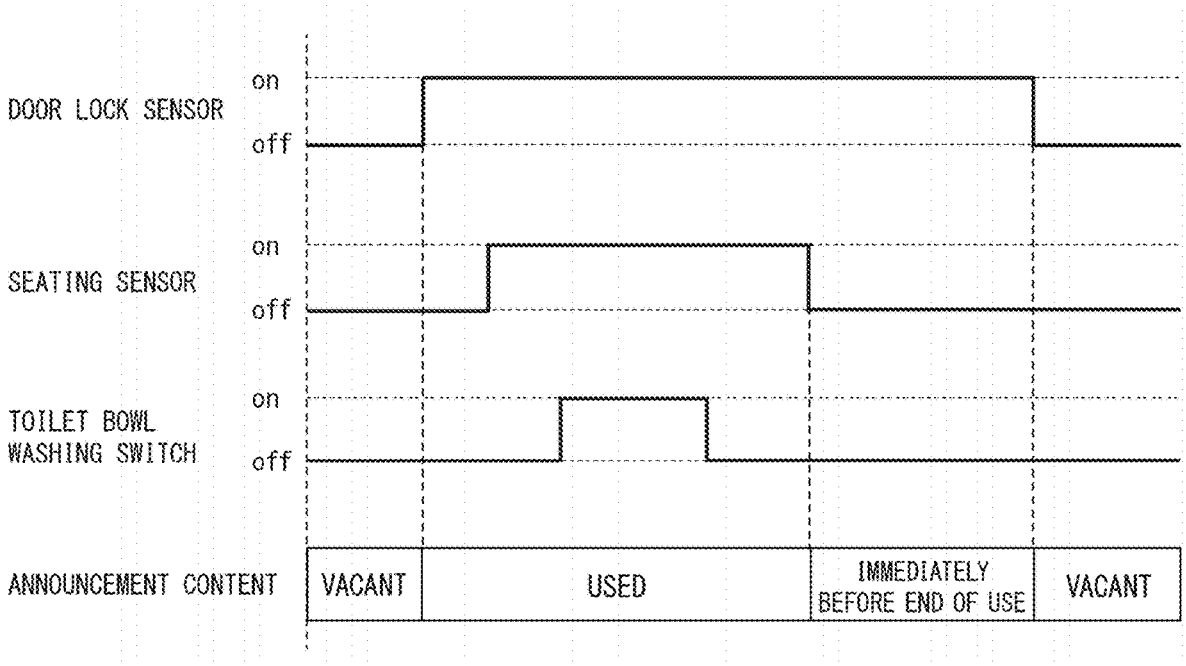
FIG. 6 is a time chart (No. 2) showing the relationship between the detection signals and the announcement contents of the toilet system, according to some embodiments.

That is, as shown in FIG. 6, in the case where the toilet washing switch 24 is operated while the seating sensor 22 is on, the announcement content of the announcement unit 40 is switched from "used" to "immediately before the end of use" upon switching of the seating sensor 22 to off after the operation of the toilet washing switch 24. At this time, the control unit 30 determines that the state of the toilet stall 10 has changed from the used state to the state immediately before the end of use based on the change in the detection result from on to off of the seating sensor 22 as the detection unit.

As described above, in the control processing of some embodiments, determination is made based on the detection results of the two detection units which detect the presence or absence of the two operations, i.e., seating and toilet bowl washing. Thus, processing is performed assuming two patterns, i.e., when toilet bowl washing is performed in a state where the user of the toilet stall 10 is not seated and when toilet bowl washing is performed in a state where the user is seated. Furthermore, the control unit 30 determines that the state of the toilet stall 10 has been changed from the used state to the state immediately before the end of use based on the change in the detection result from the on state to the off state of the seating sensor 22 as the detection unit and the change in the detection result from the off state to the on state of the toilet washing switch 24.

The control processing after step S211 is similar to that after step S108 of some embodiments. That is, in step S211, it is determined whether the door 11 has been unlocked. If it is determined that the door 11 has been unlocked, it is determined that the toilet stall 10 is "vacant" (step S212), and the "vacant" state is announced (step S213). If it is determined that the door 11 has not unlocked, it is determined again whether the user is seated (step S214), and, if seating has been confirmed again, it is determined that the toilet stall is "used" (step S215), and the "used" state is announced again (step S216). That is, as shown in FIGS. 5 and 6, when the door lock sensor 21 is switched from on to off, thereby the announcement content of the announcement unit 40 is switched from "immediately before the end of use" to "vacant".

As described above, the toilet system of some embodiments includes: the door lock sensor 21, the seating sensor 22 and the toilet washing switch 24 as the detection units which detect the situation inside the toilet stall 10; and the control unit 30 which determines, based on the detection results of the door lock sensor 21, the seating sensor 22 and the toilet washing switch 24, that the toilet stall 10 is in a vacant state and that the toilet stall 10 is in an used state, and further makes a determination that the toilet stall 10 in the used state is in the state immediately before the end of use, and outputs a signal including the determination results.

In order to detect the situation inside the toilet stall 10, the toilet system of some embodiments detects whether the door is locked by the door lock sensor 21, whether the user is seated by the seating sensor 22, and whether the toilet washing switch 24 is operated, determines that the toilet stall 10 is in the state immediately before the end of use as a state other than the two states, i.e., the vacant state and the used state, and outputs a signal including the determination results. Thus, the toilet system of some embodiments can inform the outside whether the toilet stall will be vacant soon or not.

Therefore, the toilet system of some embodiments can also provide more detailed information about the use state of the toilet.

Furthermore, the control unit 30 makes the determination that the state of the toilet stall 10 has changed from the used state to the state immediately before the end of use based on the change in the detection results of the seating sensor 22 and the toilet washing switch 24 as the detection units. Therefore, it is possible to more accurately inform the outside whether the toilet stall will be vacant soon or not.

Furthermore, when making the determination that the toilet stall 10 is in the state immediately before the end of use, the control unit 30 makes the determination only when locking and seating after locking, as a plurality of predetermined conditions, have been detected. According to this configuration, erroneous determination can be prevented. As a result, it is possible to more accurately inform the outside whether the toilet stall will be vacant soon or not.

Furthermore, when the seating sensor 22 as the detection unit detects seating as a predetermined situation after the control unit 30 determines that toilet stall 10 is in the state immediately before the end of use, the control unit 30 determines that the state of the toilet stall 10 has changed to the used state. According to this configuration, the situation inside the toilet stall can be monitored even after announcement that the state of the toilet stall is in the state immediately before the end of use, and the announcement content can be returned to "used" according to the situation. Therefore, it is possible to more accurately inform the outside whether the toilet stall will be vacant soon or not.

Furthermore, the control unit 30 determines that the toilet stall 10 in the used state is in the state immediately before the end of use, based on the detection results of the two detection units, i.e., the seating sensor 22 and the toilet washing switch 24 as the detection units. For this reason, as compared with the case where determination is made based on the detection result of the one detection unit, it is possible to more precisely and more accurately inform the outside whether the toilet stall will be vacant soon or not.

In some embodiments, the toilet system includes a rotation sensor 23, in place of the seating sensor 22, as a detection unit. That is, the toilet system of some embodiments detects the situation inside the toilet stall 10 by detecting whether the door is locked by the door lock sensor 21 and detecting whether a roll paper is rotating by the rotation sensor 23. Based on these detection results, the control unit 30 determines the use state of the toilet stall 10 and outputs a signal including the determination results. The signal output from the control unit 30 is sent to the announcement unit 40. The announcement unit 40 having received the signal announces the determination results by the control unit 30.

Figure 7:
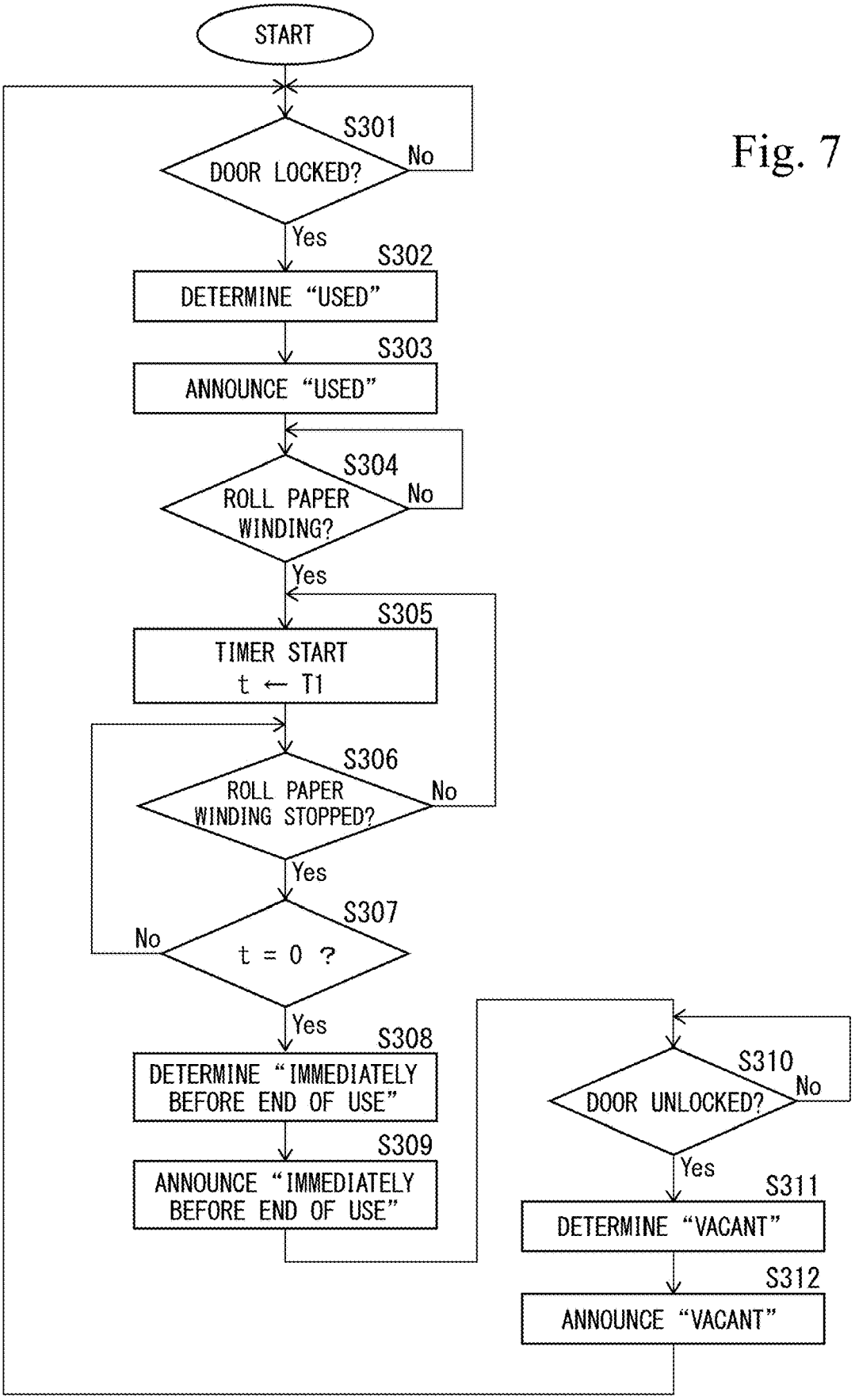
FIG. 7 is a flow chart showing the flow of processing of a toilet system, according to some embodiments.
Figure 8:
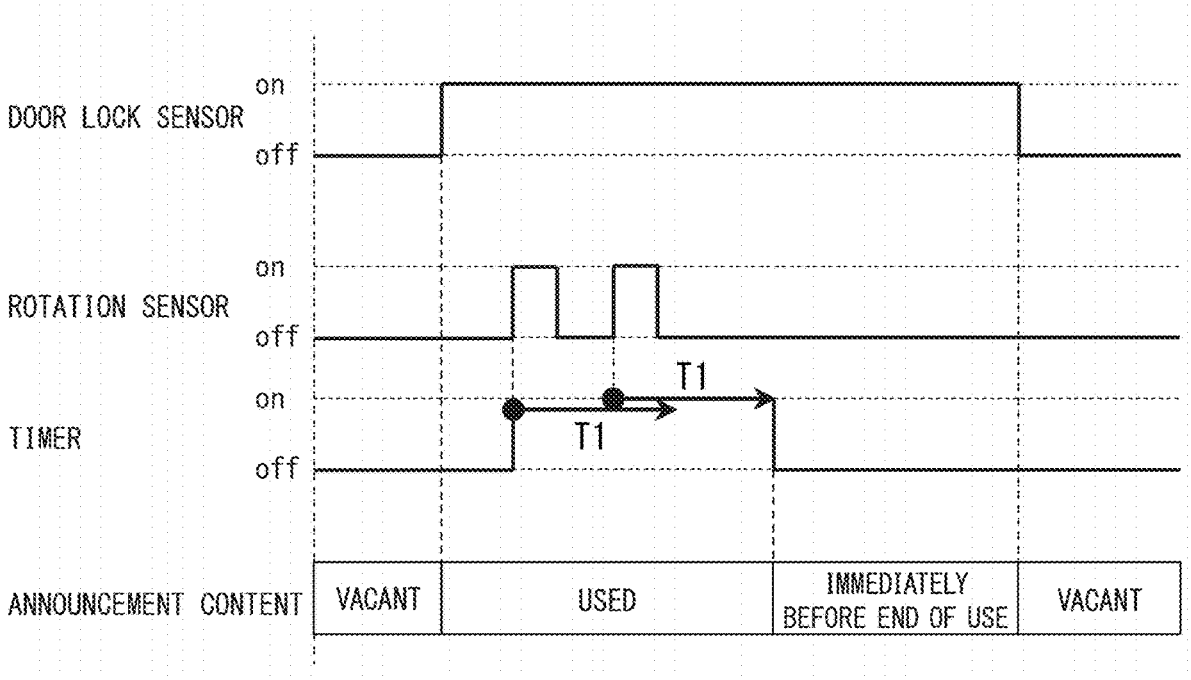
FIG. 8 is a time chart showing the relationship between detection signals and announcement contents of the toilet system, according to some embodiments.

The control processing of the toilet system having the above structure will be described using the flowchart in FIG. 7 and the timing chart in FIG. 8. As shown in FIG. 7, in the control processing of the toilet system of some embodiments, whether the door 11 is locked is detected by the door lock sensor 21 in step S301. When it is determined that the door 11 has been locked (the door lock sensor 21 is on), the control unit 30 determines that the toilet stall 10 is "used" (step S302). The announcement unit 40 announces the determination to that effect (step S303). That is, as shown in FIG. 8, when the door lock sensor 21 is switched from off to on, thereby the announcement content of the announcement unit 40 is switched from "vacant" to "used". These steps S301 to S303 are similar to steps S101 to S103. However, in the control processing of the toilet system according to some embodiments, the determination by the control unit 30 that the toilet stall 10 is in the state immediately before the end of use is made based on the determination as to whether the user of the toilet stall 10 is winding the roll paper. Specifically, the presence or absence of rotation caused by winding of the roll paper is detected by the rotation sensor 23, and, when the winding has been detected, a timer is activated. After a predetermined time has elapsed, it is determined that the toilet stall 10 is in the state immediately before the end of use.

Specifically, in step S304, it is determined whether the user of toilet stall 10 is winding the roll paper. If it is determined that the user is winding the roll paper (the rotation sensor 23 is on), the timer for a predetermined time T1 is started (step S305). After the timer is started, it is determined in step S306 whether the winding is stopped. If it is determined in step S306 that the winding is stopped (the rotation sensor 23 is off), the process proceeds to step S307 to wait for the end of the countdown by the timer. While the countdown by the timer continues, the process returns to step S306 so that the detection as to whether the user is winding the roll paper is continuously performed.

If it is determined in step S306 that the winding is not stopped (the rotation sensor 23 is on) during the countdown by the timer, the process returns to step S305 to reset the timer and to activate the timer again. This assumes that the roll paper is wound several times in one defecation. Therefore, as shown in FIG. 8, if it is detected that the roll paper has been wound again during the countdown by the timer, the timer countdown started by the detection of the previous winding is invalidated, and the timer starts again from the predetermined time T1.

When it is determined in step S307 that the timer countdown has ended, the control unit 30 determines that the toilet stall 10 is in the state immediately before the end of use (step S308). The determination result is output to the announcement unit 40. Then, the announcement unit 40 announces "immediately before the end of use" as the determination result of the control unit 30 (step S309). That is, as shown in FIG. 8, when the timer countdown ends, thereby the announcement content of the announcement unit 40 is switched from "used" to "immediately before the end of use". Thus, the control unit 30 activates the timer based on the change in the detection result from the on state to the off state of the rotation sensor 23 as the detection unit. When the timer countdown ends, thereby the control unit 30 determines that the state of the toilet stall 10 has changed from the used state to the state immediately before the end of use.

Then, in step S310, it is determined whether the door 11 has been unlocked. If it is determined that the door 11 has been unlocked, it is determined that the toilet stall 10 is "vacant" (step S311), and the "vacant" state is announced (step S312). That is, as shown in FIG. 8, when the door lock sensor 21 is switched from on to off, thereby the announcement content of the announcement unit 40 is switched from "immediately before the end of use" to "vacant".

As described above, the toilet system of some embodiments includes: the door lock sensor 21 and the rotation sensor 23 as the detection units which detect the situation inside the toilet stall 10; and the control unit 30 which determines, based on the detection results of the door lock sensor 21 and the rotation sensor 23, that the toilet stall 10 is in a vacant state and that the toilet stall 10 is in an used state, and further makes a determination that the toilet stall 10 in the used state is in the state immediately before the end of use, and outputs a signal including the determination results.

In order to detect the situation inside the toilet stall 10, the toilet system of some embodiments detects whether the door is locked by the door lock sensor 21 and whether the user is winding the roll paper by the rotation sensor 23, determines that the toilet stall 10 is in the state immediately before the end of use as a state other than the two states, i.e., the vacant state and the used state, and outputs a signal including the determination results. Thus, the toilet system of some embodiments can inform the outside whether the toilet stall will be vacant soon or not.

Therefore, the toilet system of some embodiments can also provide more detailed information about the use state of the toilet.

Furthermore, the control unit 30 activates the timer based on the change in the detection result of the rotation sensor 23 as the detection unit. When the timer countdown ends, thereby the control unit 30 determines that the toilet stall 10 has changed from the used state to the state immediately before the end of use. Therefore, it is possible to more accurately inform the outside whether the toilet stall will be vacant soon or not.

The toilet system of some embodiments has a toilet washing switch 24 as a detection unit in addition to the door lock sensor 21 and the rotation sensor 23 of some embodiments. That is, the toilet system according to some embodiments detects the situation inside the toilet stall 10 by detecting whether the door is locked by the door lock sensor 21, detecting whether the roll paper is rotating by the rotation sensor 23, and detecting whether the toilet washing switch 24 is operated. Specifically, based on these detection results, the control unit 30 determines the use state of the toilet stall 10 and outputs a signal including the determination results. The signal output from the control unit 30 is sent to the announcement unit 40. The announcement unit 40 having received the signal announces the determination results by the control unit 30.

Figure 9:
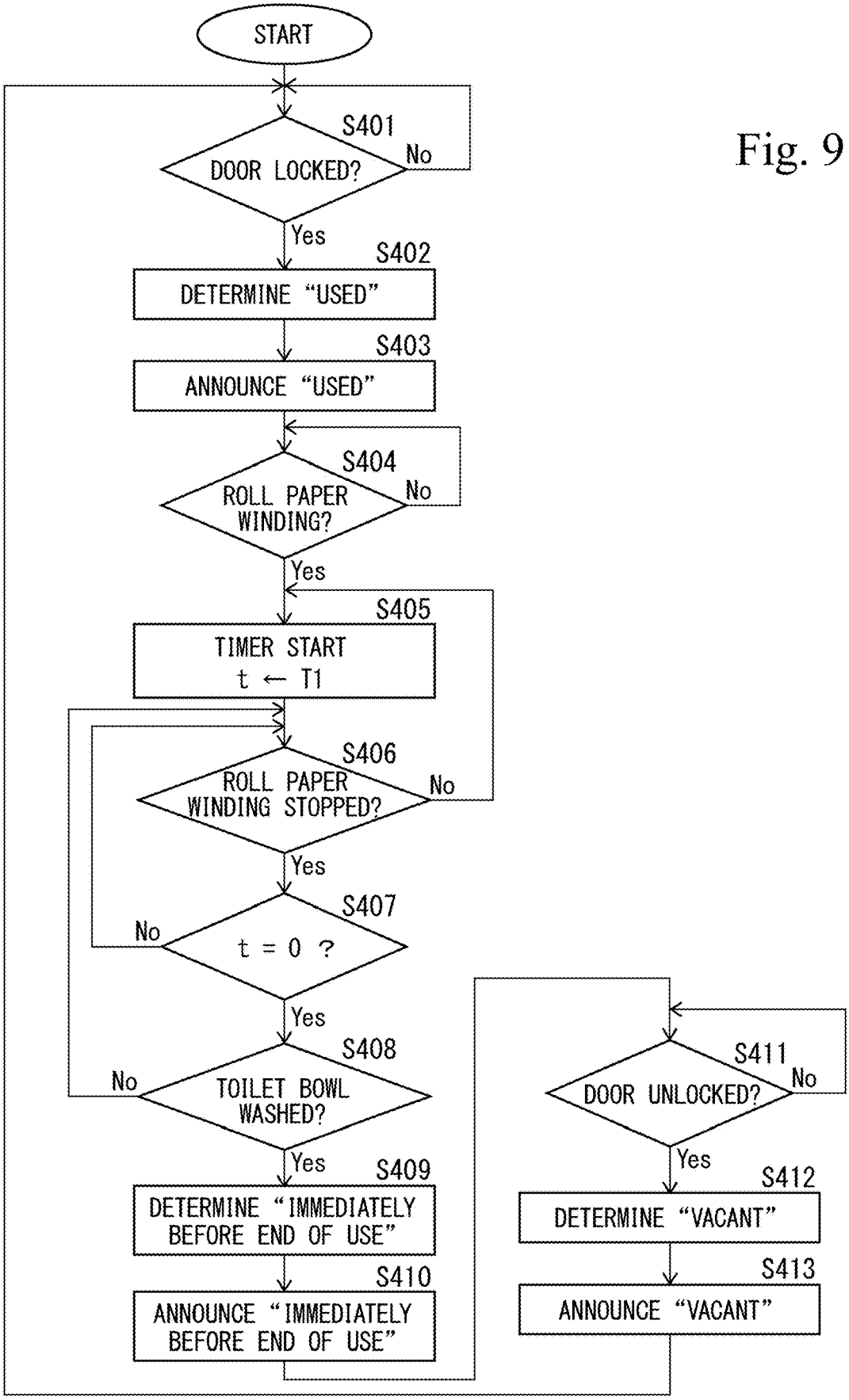
FIG. 9 is a flowchart showing the flow of processing of a toilet system, according to some embodiments.
Figure 10:
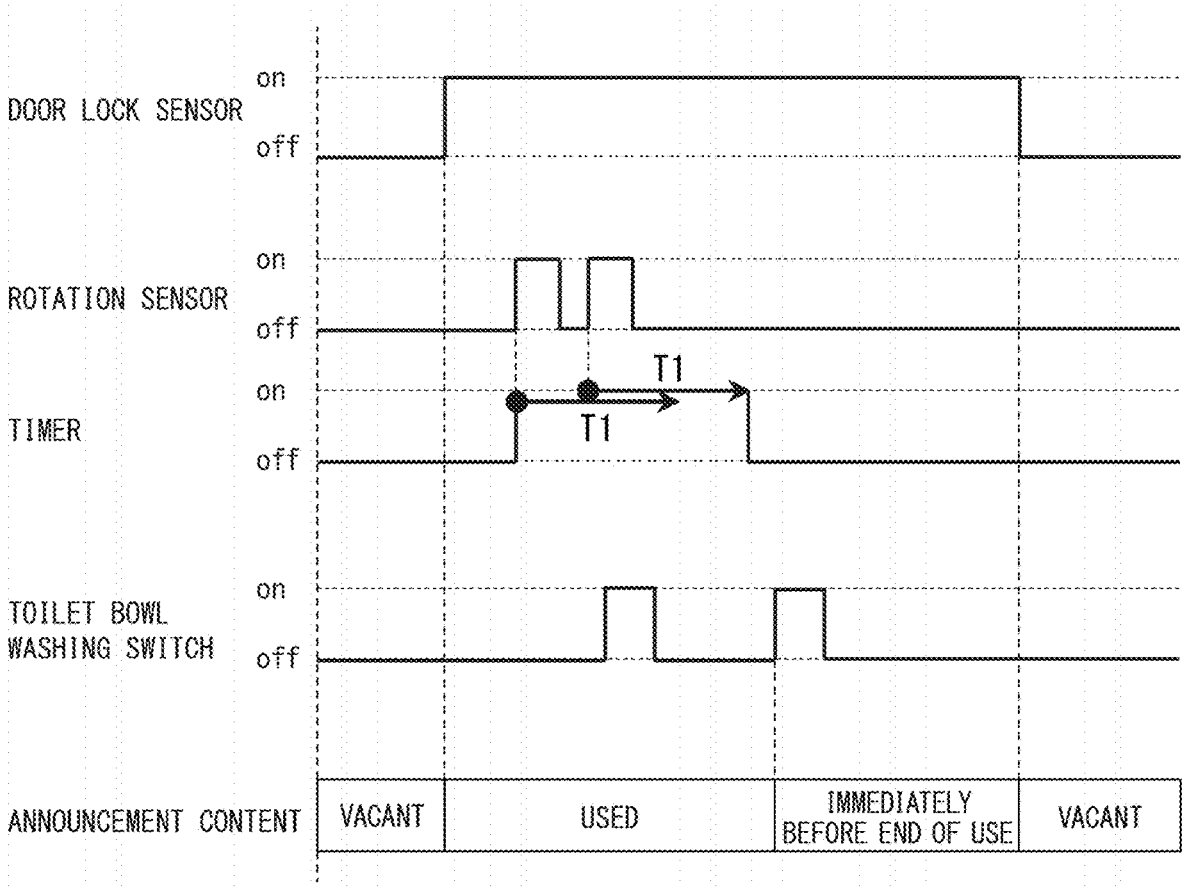
FIG. 10 is a time chart showing the relationship between detection signals and announcement contents of the toilet system, according to some embodiments.

The control processing of the toilet system having the above structure will be described using the flowchart in FIG. 9 and the timing chart in FIG. 10. As shown in FIG. 9, in the control processing of the toilet system of some embodiments, whether the door 11 is locked is detected by the door lock sensor 21 in step S401. When it is determined that the door 11 has been locked (the door lock sensor 21 is on), the control unit 30 determines that the toilet stall 10 is "used" (step S402), and the announcement unit 40 announces the determination to that effect (step S403). That is, as shown in FIG. 10, when the door lock sensor 21 is switched from off to on, thereby the announcement content of the announcement unit 40 is switched from "vacant" to "used". These steps S401 to S403 are similar to steps S101 to S103.

In step S404, it is determined whether the user of toilet stall 10 is winding the roll paper. If it is determined that the user is winding the roll paper (the rotation sensor 23 is on), the timer for a predetermined time T1 is started (step S405). Then, after the timer is started, it is determined whether the winding is stopped (step S406). If it is determined in step S406 that the winding is stopped (the rotation sensor 23 is off), the process proceeds to step S407 to wait for the end of the countdown by the timer. While the countdown by the timer continues, the process returns to step S406 so that the detection as to whether the user is winding the roll paper is continuously performed. If it is determined in step S406 that the winding is not stopped (the rotation sensor 23 is on) during the countdown by the timer, the process returns to step S405 to reset the timer and to activate the timer again. These steps S404 to S407 are also similar to steps S304 to S307 of some embodiments.

Next, in step S408, it is determined whether the toilet bowl has been washed, i.e., it is detected whether the toilet washing switch 24 has been operated. If it is determined that the toilet bowl has been washed, the determination of "immediately before the end of use" is made (step S409), and the determination result is output to the announcement unit 40. Then, the announcement unit 40 announces "immediately before the end of use" (step S410). Thus, in the control processing of the toilet system of some embodiments, the determination by the control unit 30 that the toilet stall is in the state immediately before the end of use is made based on the operation of the toilet washing switch 24, i.e., the detection of the on state of the toilet washing switch 24. However, as shown in FIG. 10, even if the on state of the toilet washing switch 24 has been detected, it is not determined that the state of the toilet stall is in the state immediately before the end of use while the countdown of the timer activated by the rotation sensor 23 continues. That is, in the toilet system of some embodiments, the control unit 30 makes the determination that the toilet stall 10 is in the state immediately before the end of use based on the change in the detection result from off to on of the toilet washing switch 24 as the detection unit. Furthermore, the control unit 30 makes the determination that the toilet stall 10 is in the state immediately before the end of use only when it is detected that the user is winding the roll paper and the timer countdown activated upon the detection of the winding has ended, which means that a plurality of predetermined conditions are satisfied.

Then, in step S411, it is determined whether the door 11 has been unlocked. If it is determined that the door 11 has been unlocked, it is determined that the toilet stall 10 is "vacant" (step S412), and the "vacant" state is announced (step S413). That is, as shown in FIG. 10, when the door lock sensor 21 is switched from on to off, thereby the announcement content of the announcement unit 40 is switched from "immediately before the end of use" to "vacant".

As described above, the toilet system of some embodiments includes: the door lock sensor 21, the rotation sensor 23 and the toilet washing switch 24 as the detection units which detect the situation inside the toilet stall 10; and the control unit 30 which determines, based on the detection results of the door lock sensor 21, the rotation sensor 23 and the toilet washing switch 24, that the toilet stall 10 is in a vacant state and that the toilet stall 10 is in an used state, and further makes a determination that the toilet stall 10 in the used state is in the state immediately before the end of use, and outputs a signal including the determination results.

In order to detect the situation inside the toilet stall 10, the toilet system of some embodiments detects whether the door is locked by the door lock sensor 21, whether the user is winding the roll paper by rotation sensor 23, and whether the toilet washing switch 24 is operated, determines that the toilet stall 10 is in the state immediately before the end of use as a state other than the two states, i.e., the vacant state and the used state, and outputs a signal including the determination results. Thus, the toilet system of some embodiments can inform the outside whether the toilet stall will be vacant soon or not.

Therefore, the toilet system of some embodiments can also provide more detailed information about the use state of the toilet.

Furthermore, the control unit 30 determines that the toilet stall 10 is in the state immediately before the end of use based on the change in the detection result from off to on of the toilet washing switch 24 as the detection unit. Therefore, it is possible to more accurately inform the outside whether the toilet stall will be vacant soon or not.

Furthermore, when making the determination that the toilet stall 10 is in the state immediately before the end of use, the control unit 30 determines the determination only when it is detected that the user is winding the roll paper (winding is started) and the timer countdown activated by the detection of winding has ended, which means that a plurality of predetermined conditions are satisfied. According to this configuration, erroneous determination can be prevented. As a result, it is possible to more accurately inform the outside whether the toilet stall will be vacant soon or not.

The toilet system of some embodiments includes control unit 30 that determines that the toilet stall 10 in the used state is in the state immediately after the start of use based on the detection result of the detection unit. The toilet system of some embodiments has the door lock sensor 21 as a detection unit. In some embodiments, the control unit 30 determines the use state of the toilet stall 10 based on the detection result of the detection unit, and outputs the determination results. The signal output from the control unit 30 is sent to the announcement unit 40. The announcement unit 40 having received the signal announces the determination results by the control unit 30.

Figure 11:
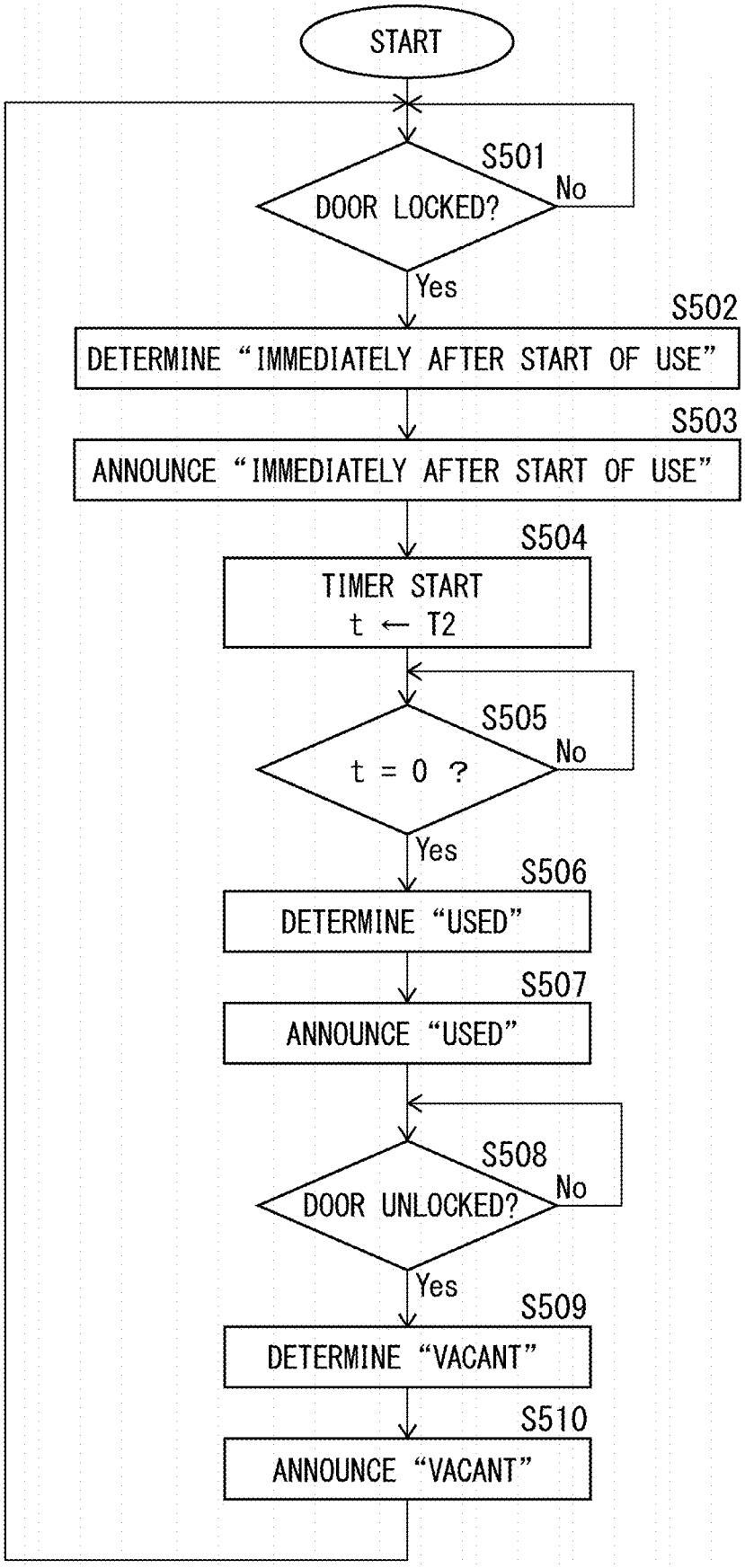
FIG. 11 is a flowchart showing the flow of processing of a toilet system, according to some embodiments.
Figure 12:
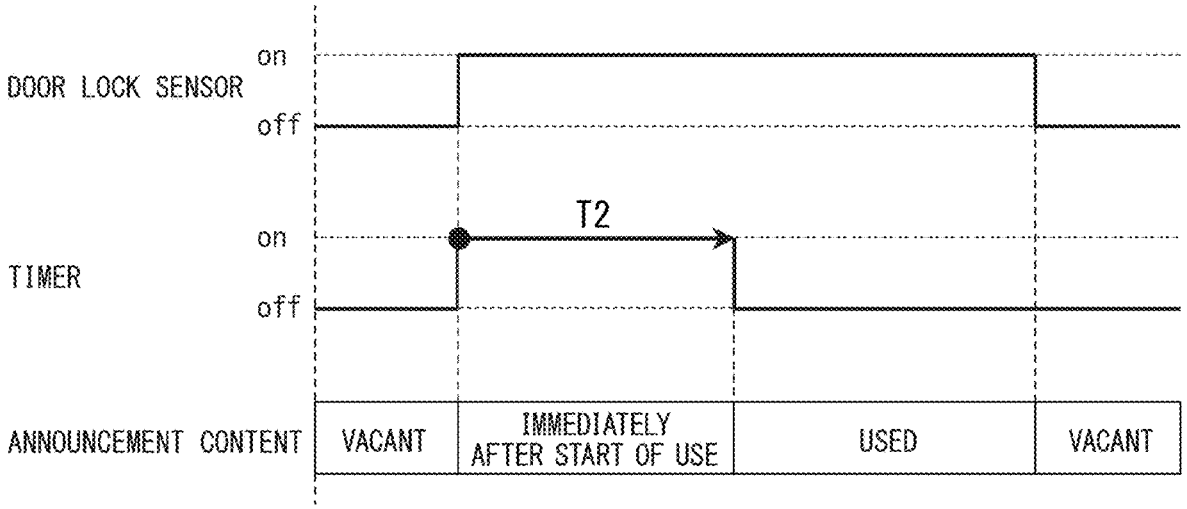
FIG. 12 is a time chart showing the relationship between detection signals and announcement contents of the toilet system, according to some embodiments.

The control processing of the toilet system having the above structure will be described using the flowchart in FIG. 11, and the timing chart in FIG. 12. As shown in FIG. 11, in the control processing of the toilet system, the door lock sensor 21 detects whether the door 11 is locked in step S501. If it is determined in step S501 that the door 11 has been locked (the door lock sensor 21 is on), the control unit 30 determines that the toilet stall 10 is in the state immediately after the start of use (step S502). That is, when the on state of the door lock sensor 21 is detected, thereby the control unit 30 determines that the toilet stall 10 is in the state immediately after the start of use in the used state. The determination result is output to the announcement unit 40. Then, the announcement unit 40 announces the determination result by the control unit 30 (step S503). As shown in FIG. 12, when the door lock sensor 21 is switched from off to on, thereby the announcement content of the announcement unit 40 is switched from "vacant" to "immediately after the start of use".

In step S504, a timer for a predetermined time T2 is started. Then, in step S505, the end of the countdown by the timer is waited for. When the countdown by the timer is completed, the control unit 30 determines that the state of the toilet stall 10 has changed from the state immediately after the start of use to the used state (step S506), and the "used" state is announced (step S507). That is, when the predetermined time T2 has elapsed after the determination that the toilet stall 10 is in the state immediately after the start of use, the control unit 30 determines that the toilet stall 10 is in the used state.

The processing in steps S508 to S510 is similar to that in steps S310 to S312. That is, in step S508, it is determined whether the door 11 has been unlocked. If it is determined that the door has 11 been unlocked, it is determined that the toilet stall 10 is "vacant" (step S509). The announcement unit 40 announces "vacant" (step S510). That is, as shown in FIG. 12, when the door lock sensor 21 is switched from on to off, thereby the announcement content of the announcement unit 40 is switched from "used" to "vacant".

As described above, the toilet system of some embodiments includes: the door lock sensor 21 as the detection unit which detects the situation inside the toilet stall 10; and the control unit 30 which determines, based on the detection result of the door lock sensor 21, that the toilet stall 10 is in the state immediately after the start of use as a state other than the two states, i.e., the vacant state and the used state, and outputs a signal including the determination results.

In order to detect the situation inside the toilet stall 10, the toilet system of some embodiments detects whether the door is locked by the door lock sensor 21, determines that the toilet stall 10 is in the state immediately after the start of use as a state other than the two states, i.e., the vacant state and the used state, and outputs a signal including the determination results. Thus, the toilet system of some embodiments can provide the information that the toilet stall has just started to be used, and therefore can inform the outside whether the toilet stall will be vacant soon or not.

Therefore, the toilet system of some embodiments can also provide more detailed information about the use state of the toilet.

Furthermore, the toilet system of some embodiments has only the door lock sensor 21 which detects whether the door 11 is locked as the detection unit, and therefore can have a simple structure.

The toilet system of some embodiments includes seating sensor 22, in addition to the door lock sensor 21, as the detection unit. The toilet system of some embodiments detects the situation inside the toilet stall 10 by detecting whether the door is locked by the door lock sensor 21 and whether the user is seated by the seating sensor 22. The control unit 30 determines the use state of the toilet stall 10 based on the detection results of the detection units and outputs the determination results.

Figure 13:
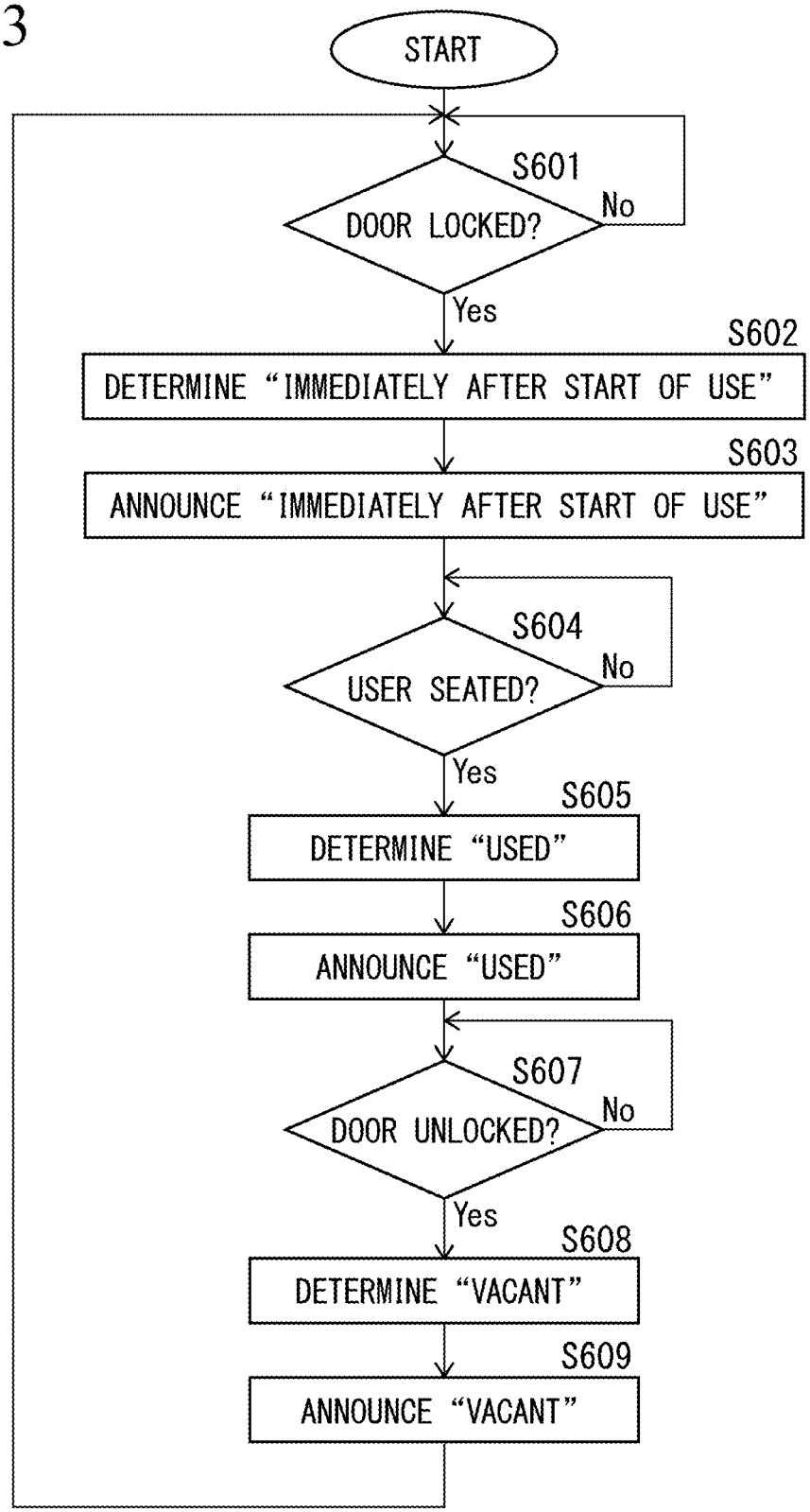
FIG. 13 is a flowchart showing the flow of processing of a toilet system, according to some embodiments.
Figure 14:
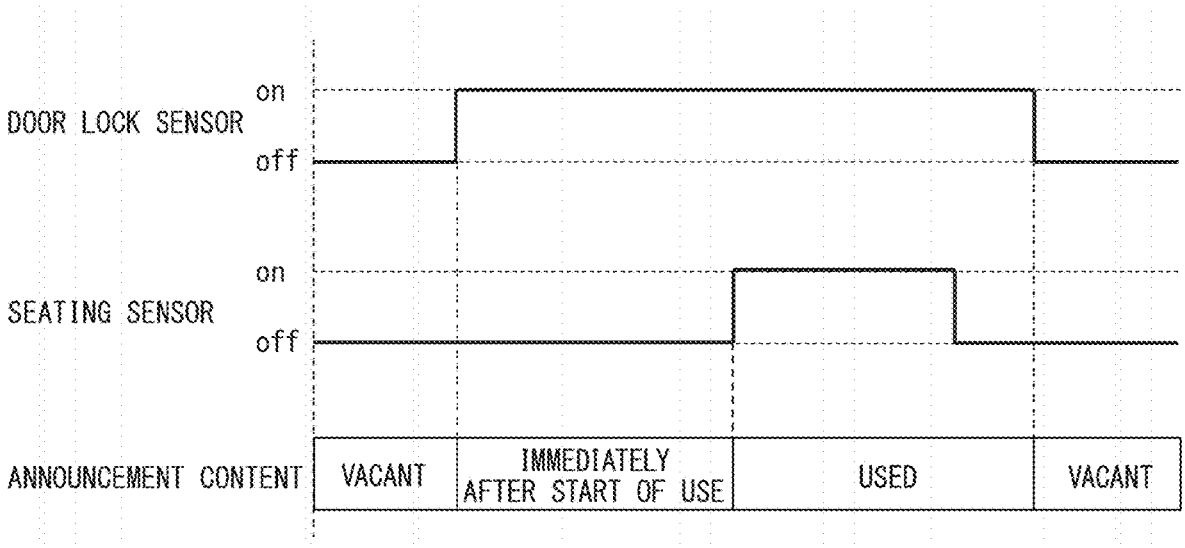
FIG. 14 is a time chart showing the relationship between detection signals and announcement contents of the toilet system, according to some embodiments.

The control processing of the toilet system having the above structure will be described using the flowchart in FIG. 13, and the timing chart in FIG. 14. As shown in FIG. 13, in the control processing of the toilet system, locking of the door 11 is detected in step S601. When it is determined that the door 11 has been locked (the door lock sensor 21 is on), the control unit 30 determines that the toilet stall 10 is in the state "immediately after the start of use" (step S602), and outputs the determination result to the announcement unit 40. The announcement unit 40 announces the determination to that effect (step S603). That is, as shown in FIG. 14, when the door lock sensor 21 is switched from off to on, thereby the announcement content of the announcement unit 40 is switched from "vacant" to "immediately after the start of use".

In step S604, it is determined whether the user of the toilet stall 10 has been seated on the toilet seat of the toilet bowl device 12. If it is determined that the user has been seated (the seating sensor 22 is on), the control unit 30 determines that the toilet stall 10 is "used" (step S605), and the announcement unit 40 announces that the toilet stall 10 is "used" (step S606). That is, as shown in FIG. 14, when the seating sensor 22 is switched from off to on, thereby the announcement content of the announcement unit 40 is switched from "immediately after the start of use" to "used". Thus, in the toilet system according to some embodiments, it is determined that the toilet stall 10 is in the state immediately after the start of use by detecting the locking of the door 11, and it is determined that the state of the toilet stool 10 has changed to the used state by detecting the seating of the user.

The processing in steps S607 to S609 is similar to that in steps S508 to S510. That is, in step S607, it is determined whether the door 11 has been unlocked. If it is determined that the door 11 has been unlocked, it is determined that the toilet stall 10 is "vacant" (step S608). The announcement unit 40 announces "vacant" (step S609). That is, as shown in FIG. 14, when the door lock sensor 21 is switched from on to off, thereby the announcement content of the announcement unit 40 is switched from "used" to "vacant".

As described above, the toilet system of some embodiments includes: the door lock sensor 21 and the seating sensor 22 as the detection units which detect the situation inside the toilet stall 10; and the control unit 30 which determines, based on the detection results of the door lock sensor 21 and the seating sensor 22, that the toilet stall 10 is in the state immediately after the start of use as a state other than the two states, i.e., the vacant state and the used state, and outputs a signal including the determination results.

In order to detect the situation inside the toilet stall 10, the toilet system of some embodiments detects whether the door is locked by the door lock sensor 21 and whether the user is seated by the seating sensor 22, determines that the toilet stall 10 is in the state immediately after the start of use as a state other than the two states, i.e., the vacant state and the used state, and outputs a signal including the determination results. Thus, the toilet system of some embodiments can provide the information that the toilet stall has just started to be used, and therefore can inform the outside whether the toilet stall will be vacant soon or not.

Therefore, the toilet system of some embodiments can also provide more detailed information about the use state of the toilet.

The toilet system of some embodiments has the door lock sensor 21 and the seating sensor 22 as detection units. The toilet system of some embodiments detects the situation inside the toilet stall 10 by detecting whether the door is locked by the door lock sensor 21 and whether the user is seated by the seating sensor 22. The control unit 30 determines the use state of the toilet stall 10 based on the detection results of the detection units. In some embodiments, the determination that the state immediately after the start of use has changed to the used state is made upon the ending of the countdown of the timer activated by the detection of the locking or upon the detection of the seating, whichever comes earlier.

Figure 15:
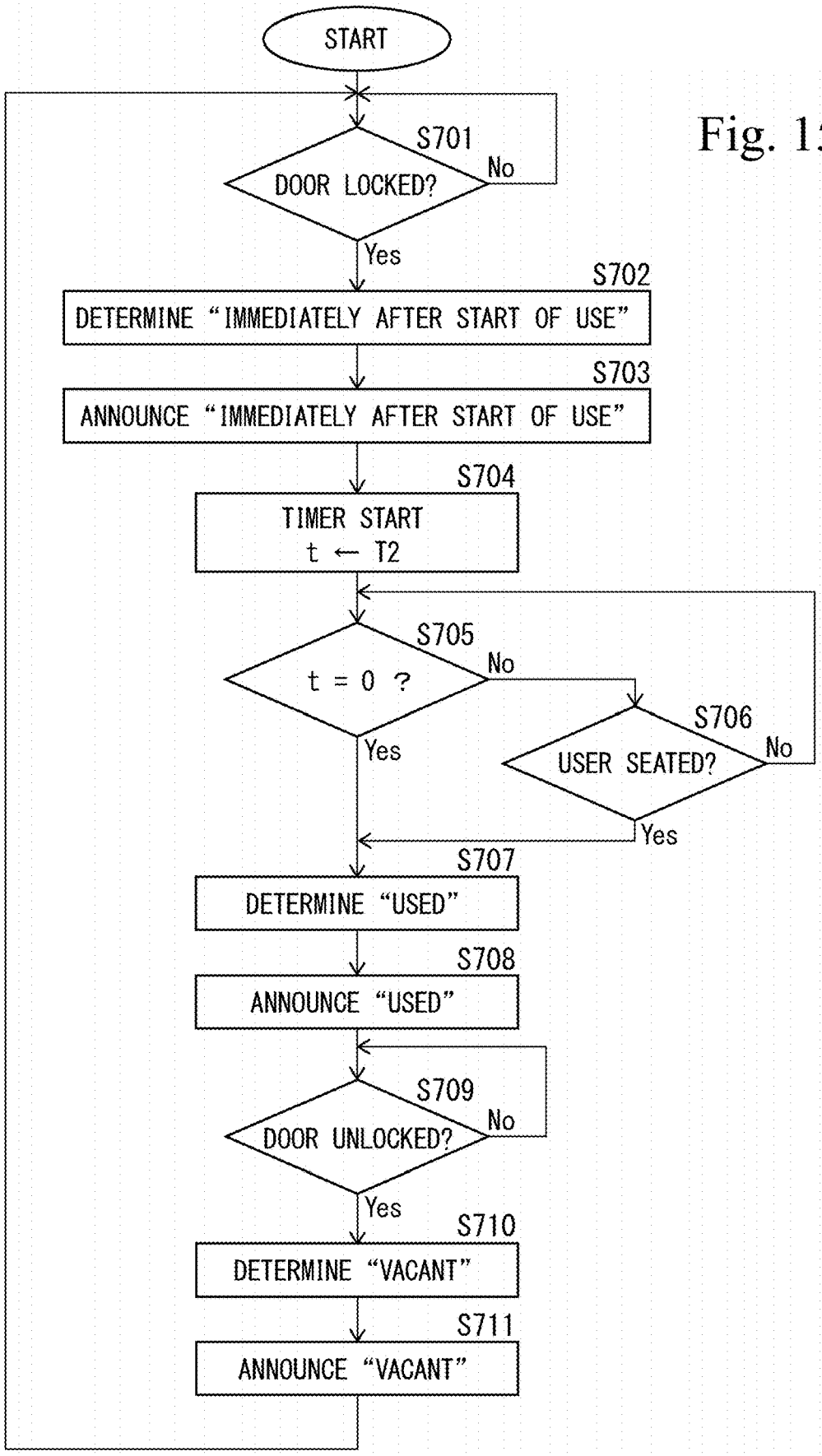
FIG. 15 is a flowchart showing the flow of processing of a toilet system, according to some embodiments.
Figure 16:
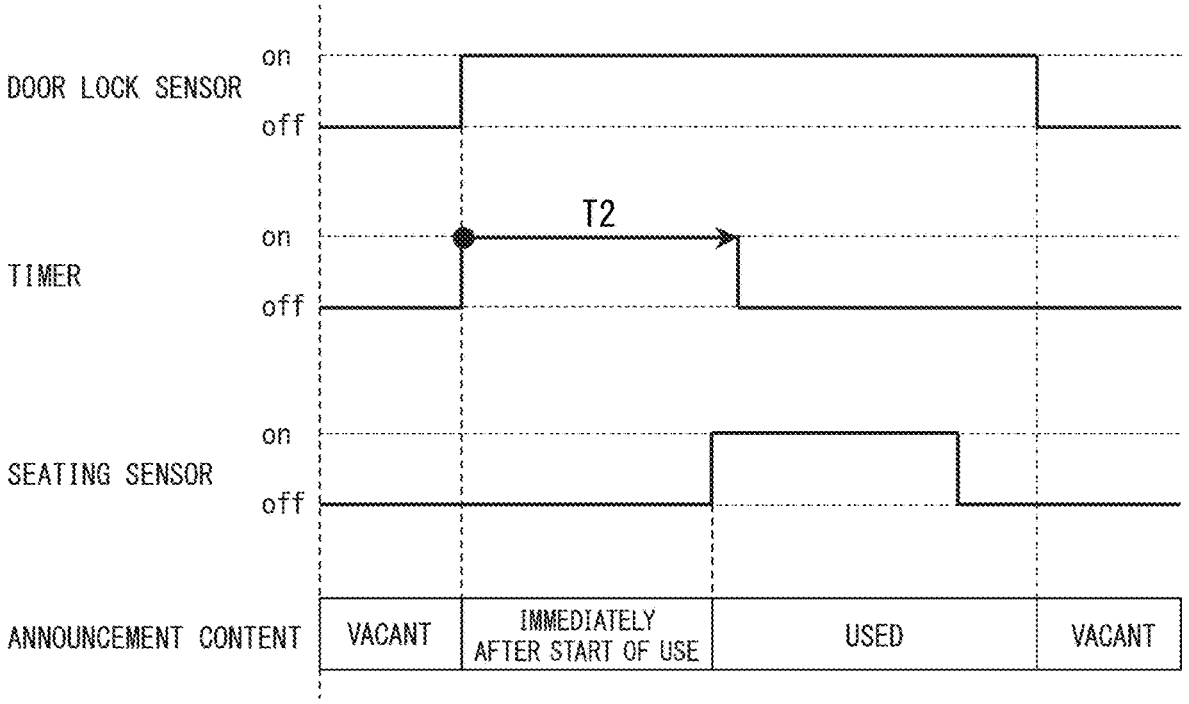
FIG. 16 is a time chart (No. 1) showing the relationship between detection signals and announcement contents of the toilet system, according to some embodiments.
Figure 17:
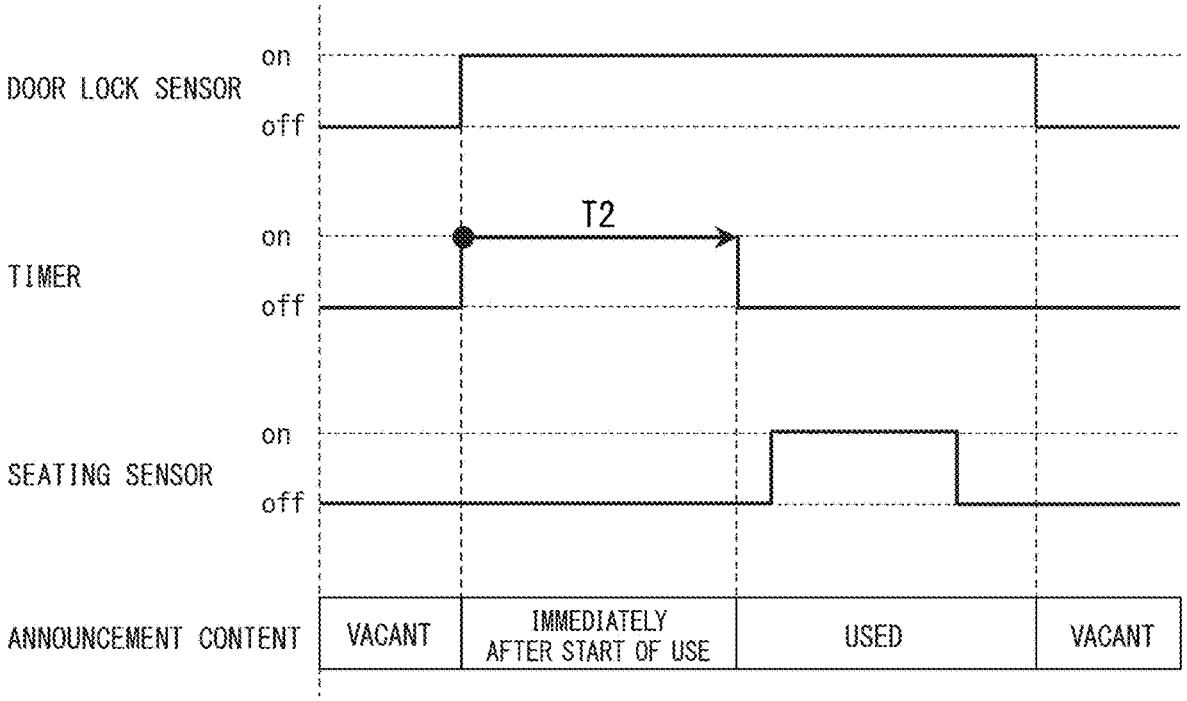
FIG. 17 is a time chart (No. 2) showing the relationship between the detection signals and the announcement contents of the toilet system, according to some embodiments.

The control processing of the toilet system having the above structure will be described using the flowchart in FIG. 15 and the timing charts in FIGS. 16 and 17. As shown in FIG. 15, in the control processing of the toilet system, locking of the door 11 is detected in step S701. When it is determined that the door 11 has been locked (the door lock sensor 21 is on), the control unit 30 determines that the toilet stall 10 is in the state "immediately after the start of use" (step S702), and outputs the determination result to the announcement unit 40. The announcement unit 40 announces the result to that effect (step S703). That is, as shown in FIGS. 16 and 17, when the door lock sensor 21 is switched from off to on, thereby the announcement content of the announcement unit 40 is switched from "vacant" to "immediately after the start of use".

In step S704, a timer for a predetermined time T2 is started. Then, in step S705, it is determined whether the countdown by the timer has ended. If it is not determined that the timer countdown has ended, the process proceeds to step S706, and whether the user is seated is detected by the seating sensor 22. If it is determined in step S705 that the timer countdown has ended, or if it is determined in step S706 that the user has been seated (the seating sensor 22 is on), the control unit 30 determines that the toilet stall 10 is in the used state in step S707, and the announcement unit 40 announces the used state in step S708. That is, when the seating sensor 22 is switched from off to on before the timer countdown ends as shown in FIG. 16, or when the timer countdown ends before the seating sensor 22 is switched from off to on as shown in FIG. 17, thereby the announcement content of the announcement unit 40 is switched from "immediately after the start of use" to "used".

The processing in steps S709 to S711 is similar to that in steps S508 to S510. That is, in step S709, it is determined whether the door 11 has been unlocked. If it is determined that the door 11 has been unlocked, it is determined that the toilet stall 10 is "vacant" (step S710). The announcement unit 40 announces "vacant" (step S711). That is, as shown in FIGS. 16 and 17, when the door lock sensor 21 is switched from on to off, thereby the announcement content of the announcement unit 40 is switched from "used" to "vacant".

As described above, the toilet system of some embodiments includes: the door lock sensor 21 and the seating sensor 22 as the detection units which detect the situation inside the toilet stall 10; and the control unit 30 which determines, based on the detection results of the door lock sensor 21 and the seating sensor 22, that the toilet stall 10 is in the state immediately after the start of use as a state other than the two states, i.e., the vacant state and the used state, and outputs a signal including the determination results.

In order to detect the situation inside the toilet stall 10, the toilet system of some embodiments detects whether the door is locked by the door lock sensor 21 and whether the user is seated by the seating sensor 22, determines that the toilet stall 10 is in the state immediately after the start of use as a state other than the two states, i.e., the vacant state and the used state, and outputs a signal including the determination results. Thus, the toilet system of some embodiments can provide the information that the toilet stall has just started to be used, and therefore can inform the outside whether the toilet stall will be vacant soon or not.

Therefore, the toilet system of some embodiments can also provide more detailed information about the use state of the toilet.

The present invention is not limited to the Embodiments explained with reference to the above description and drawings. For example, the following embodiments are also included in the technical scope of the present invention.

(1) In some embodiments, the toilet facility is provided with three toilet stalls, but the number of toilet stalls is not particularly limited.

(2) In some embodiments, one announcement unit is provided for announcing the use state of a plurality of toilet stalls, but multiple announcement units may be provided so that each announcement unit corresponds to each toilet stall.

(3) In some embodiments, characters, figures, etc. are displayed on the indicator as the announcement form of the announcement unit. However, simple display such as mere color display may be employed. Furthermore, the announcement form is not limited to the form announcing information about the use state of each toilet stall but other announcement form may be employed; for example, the number of "vacant" or "used" toilet stalls in the entire toilet facility may be announced.

(4) In some embodiments, the indicator provided on the outer wall of the toilet facility is described as the announcement unit, but the indicator may be provided in the common space. Furthermore, the announcement unit may be configured to display remotely from the toilet facility by using a display provided in a place away from the toilet facility, a portable terminal such as a smart phone, or the like.

(5) In some embodiments, the indicator is described as the announcement unit, but the announcement unit configured to announce by sound or the like may be employed.

(6) In some embodiments, the door lock sensor, the seating sensor, the rotation sensor, the toilet washing switch and the like are provided as the detection units, but the detection units are not limited thereto. For example, there may be employed detection units which detect other operations, such as opening and closing of the toilet seat (auxiliary toilet seat for infants) and/or the toilet lid, use of a diaper changing table, seating on an infant chair, private part washing, change in water level in the toilet bowl due to defecation, change in water flow in a water supply pipe due to toilet bowl washing and/or private part washing, dressing and undressing, entering and leaving, and the like. Furthermore, the detection methods and detection means by the detection units are not specifically limited, either.

(7) In some embodiments, either one of the state immediately before the end of use and the state immediately after the start of use is determined in addition to the vacant state and the used state, as the use state of the toilet stall, but the present invention is not limited thereto. Alternatively, any other state may be determined instead of or in addition to the state immediately before the end of use and the state immediately after the start of use.

(8) In some embodiments, the presence or absence of rotation caused by winding of the roll paper is detected by the rotation sensor so that timer is activated, and the determination that the toilet stall is in the state immediately before the end of use is made when the timer countdown ends. However, the determination that the toilet stall is in the state immediately before the end of use may be made only by the detection of the presence or absence of rotation by the rotation sensor.

The invention claimed is:

1. A toilet system comprising:

a detection unit configured to detect a situation inside a toilet stall; and a control unit configured to determine, based on a detection result of the detection unit, that the toilet stall is in a vacant state or in a used state, is configured to make at least one of a determination that the toilet stall in the used state is in a state immediately after a start of use or a determination that the toilet stall in the used state is in a state immediately before an end of use, and is configured to output a signal including determination results.

2. The toilet system of claim 1, wherein the control unit is configured to make, based on a change in the detection result of the detection unit, at least one of a determination that the toilet stall has changed from the state immediately after the start of use to the used state or a determination that the toilet stall has changed from the used state to the state immediately before the end of use.

3. The toilet system of claim 1, wherein, the control unit is configured to make the determination that the toilet stall is in the state immediately before the end of use once a plurality of predetermined conditions is satisfied.

4. The toilet system of claim 1, wherein, when the detection unit detects a predetermined situation after the control unit determines that the toilet stall is in the state immediately before the end of use, the control unit is configured to determine that the toilet stall has changed to the used state.

5. The toilet system of claim 1, wherein the control unit is configured to make at least a determination that the toilet stall is in the state immediately after the start of use.

6. The toilet system of claim 1, wherein the control unit is configured to make at least a determination that the toilet stall is in the state immediately before the end of use.

7. The toilet system of claim 2, wherein, the control unit is configured to make the determination that the toilet stall is in the state immediately before the end of use once a plurality of predetermined conditions is satisfied.

8. The toilet system of claim 2, wherein, when the detection unit detects a predetermined situation after the control unit determines that the toilet stall is in the state immediately before the end of use, the control unit is configured to determine that the toilet stall has changed to the used state.

9. The toilet system of claim 2, wherein the control unit is configured to make at least a determination that the toilet stall is in the state immediately after the start of use.

10. The toilet system of claim 2, wherein the control unit is configured to make at least a determination that the toilet stall is in the state immediately before the end of use.

11. The toilet system of claim 3, wherein, when the detection unit detects a predetermined situation after the control unit determines that the toilet stall is in the state immediately before the end of use, the control unit is configured to determine that the toilet stall has changed to the used state.

12. The toilet system of claim 6, wherein, the control unit is configured to make the determination that the toilet stall is in the state immediately before the end of use once a plurality of predetermined conditions is satisfied.

13. The toilet system of claim 6, wherein, when the detection unit detects a predetermined situation after the control unit determines that the toilet stall is in the state immediately before the end of use, the control unit is configured to determine that the toilet stall has changed to the used state.

14. The toilet system of claim 7, wherein, when the detection unit detects a predetermined situation after the control unit determines that the toilet stall is in the state immediately before the end of use, the control unit is configured to determine that the toilet stall has changed to the used state.

15. The toilet system of claim 10, wherein, the control unit is configured to make the determination that the toilet stall is in the state immediately before the end of use once a plurality of predetermined conditions is satisfied.

16. The toilet system of claim 10, wherein, when the detection unit detects a predetermined situation after the control unit determines that the toilet stall is in the state immediately before the end of use, the control unit is configured to determine that the toilet stall has changed to the used state.

17. The toilet system of claim 12, wherein, when the detection unit detects a predetermined situation after the control unit determines that the toilet stall is in the state immediately before the end of use, the control unit is configured to determine that the toilet stall has changed to the used state.

18. The toilet system of claim 15, wherein, when the detection unit detects a predetermined situation after the control unit determines that the toilet stall is in the state immediately before the end of use, the control unit is configured to determine that the toilet stall has changed to the used state.

* * * * *